US005222426A

United States Patent [19]

Marcon et al.

[11] Patent Number: 5,222,426

[45] Date of Patent: Jun. 29, 1993

[54] PROPORTIONAL DISTRIBUTOR AND CONTROL SYSTEM FOR A PLURALITY OF HYDRAULIC RECEIVERS INCORPORATING A DISTRIBUTOR OF THIS KIND FOR EACH RECEIVER

[75] Inventors: Louis Marcon, St. Etienne; André Rousset, St. Priest En Jarrez, both of France

[73] Assignee: Marrel, France

[21] Appl. No.: 831,816

[22] Filed: Feb. 6, 1992

[30] Foreign Application Priority Data

Feb. 15, 1991 [FR] France ..... 91 01848

[51] Int. Cl.[5] ..... F15B 11/08; F15B 13/04

[52] U.S. Cl. ..... 91/446; 91/448; 91/508; 60/420

[58] Field of Search ..... 91/444, 446, 448, 468, 91/508; 60/420, 459, 463

[56] References Cited

U.S. PATENT DOCUMENTS

| | | | |
|---|---|---|---|
| 4,259,986 | 4/1981 | Maucher et al. | 91/448 X |
| 4,487,018 | 12/1984 | Budzich | 60/452 |
| 4,570,672 | 2/1986 | Wilke | 91/448 X |
| 4,799,420 | 1/1989 | Budzigh | 91/446 X |
| 4,842,019 | 6/1989 | Rousset et al. | 91/446 X |
| 5,038,671 | 8/1991 | Veno | 91/446 X |

FOREIGN PATENT DOCUMENTS

| | | |
|---|---|---|
| 0326150 | 8/1989 | European Pat. Off. . |
| 0341650 | 11/1989 | European Pat. Off. . |
| 0368636 | 5/1990 | European Pat. Off. . |
| 0377544 | 7/1990 | European Pat. Off. . |
| 2548290 | 1/1985 | France . |
| 2587419 | 3/1987 | France . |
| 8605245 | 9/1986 | World Int. Prop. O. . |
| 9013748 | 11/1990 | World Int. Prop. O. . |

*Primary Examiner*—Edward K. Look
*Assistant Examiner*—Hoang Nguyen
*Attorney, Agent, or Firm*—Remy J. VanOphem

[57] ABSTRACT

A proportional distributor embodying a controlled slide valve and a pressure compensator slide valve associated with additional positioning means whereby the pressure drop in the controlled slide valve depends upon the difference between the working and load sensing pressures according to a linear function with a strictly positive coefficient and a strictly negative constant. Each compensator slide valve operates according to the same linear function or at least one of its proportional distributors has a compensator slide valve operating according to a different linear function.

18 Claims, 2 Drawing Sheets

PROPORTIONAL DISTRIBUTOR AND CONTROL SYSTEM FOR A PLURALITY OF HYDRAULIC RECEIVERS INCORPORATING A DISTRIBUTOR OF THIS KIND FOR EACH RECEIVER

BACKGROUND OF THE INVENTION

The invention concerns proportional hydraulic distributors.

Such distributors are disposed between a flow generator and a receiver to control the operation of the receiver by adapting the manner in which it is connected to the flow generator.

Proportional type distributors include not only a controlled slide valve whose position determines the cross section of a flow restriction but also an automatic compensator slide valve to maintain a constant pressure differential between the upstream and downstream sides of the flow restriction so that for a given position of the control slide valve there is a given flow rate of fluid. Consequently, if a receiver is commanded by means of a proportional distributor its speed of operation is set by the position of the controlled slide valve independently of the load on the receiver.

If the flow generator is used to feed a plurality of receivers for each of which there is a proportional distributor the total flow rate demanded by the receivers may exceed the maximum flow rate that the pump is able to provide. The respective compensator slide valves are then no longer able to maintain the pressure differential between the upstream and the downstream sides of the flow restriction in each of the distributors at the predetermined constant value with the result that the most heavily loaded receivers slow down or stop while the least heavily loaded may continue to operate.

SUMMARY OF THE INVENTION

The present invention is directed to solving this problem. More particularly, a circuit constitutes a load sensing means which feeds back to the flow generator the pressure of the most heavily loaded receiver, to which the flow generator responds by producing a working pressure equal to the load sensing pressure plus a constant pressure, and the distributor constitutes a compensator slide valve which automatically assumes a position in which it produces on the upstream side of the flow restriction of the controlled slide valve a second flow restriction of appropriate cross section. The compensator slide valve has two opposed active surfaces, a first surface exposed to the pressure on the upstream side of the first flow restriction to urge the controlled slide valve in the closing direction and a second surface exposed to the pressure on the downstream side of the first flow restriction to urge the compensator slide valve in the opening direction.

To this end the present invention proposes a proportional distributor characterized in that it possesses additional means by which the compensator slide valve is further urged in the closed direction by the load sensing pressure plus a substantial constant force, and it is urged in the open direction by the working pressure. The first and second active surfaces of the compensator slide valve and the additional means are rated so that when in service the pressure differential between the upstream and the downstream sides of the first flow restriction depends upon the differential between the working pressure and the load sensing pressure according to a linear function with a strictly positive coefficient and a strictly negative constant.

If $P_i$ denotes the pressure on the upstream side of the flow restriction, $PU_i$ the pressure on the downstream side of the flow restriction, P the working pressure and PU the load sensing pressure, then the compensator slide valve maintains the pressure drop $P_i-PU_i$ in the flow restriction of the controlled slide valve according to the equation:

$$P_i-PU_i=k_1(P-PU)-k_2$$

in which $k_1$ and $k_2$ are strictly positive.

Provided that the flow generator functions normally P−PU remains constant and consequently $P_i-PU_i$ remains constant, which means that the compensator slide valve functions as in the prior art and in particular as in the Applicant's French patent 84-06747 in which the compensator slide valve is urged in the open direction by a spring.

If the flow rate demanded is greater than that which can be provided, P−PU falls below its normal value so that $P_i-PU_i$ will decrease. If each of the distributors in the installation is a distributor in accordance with the invention and if they have all been set up with the same coefficient $k_1$ and the same constant $-k_2$, then the value of $P_i-PU_i$ will decrease by the same amount in each of the distributors. As a result, the same rate of flow rate reduction is applied to each distributor (it is equal to: flow rate available from flow generator/total flow rate demanded).

Thus each of the receivers slows down in response to an excessive flow rate demand, the speed ratios between the receivers being maintained.

Note that it is essential that a force is applied to the compensator slide valve in the closing direction. Without such force the technical problem of preventing the aforementioned problems in the case of excessive flow rate demand would only be partially solved.

As a matter of fact, there comes a time at which P−PU reaches a value that is too low for the required value of $P_i-PU_i$ to be achieved in some distributors, especially that for the mos heavily loaded receiver. If the receivers continue to be supplied, problems similar to those previously encountered will arise.

However, with a force applied in the closing direction it is possible to fully close the compensator slide valve if the value of P−PU drops too low. Consequently, with a battery of proportional distributors in accordance with the invention and in the event of an excessive flow rate demand the speed ratios between the receivers can be kept constant up to the point at which all the receivers are stopped because the demand is too large for all the ratios to be maintained.

Proportional distributors in accordance with the invention are, therefore, particularly advantageous from a security standpoint, for example, in a civil engineering plant where proportional distributors can prevent all risks of accident when an excessive flow rate is demanded because the driver can no longer lose control of the various rams, as was previously the case.

According to preferred features of the invention, the additional means includes:

on each side of the compensator slide valve, a piston movable coaxially and adapted to come into contact with or attached to the compensator slide valve, two opposite active surfaces, a first surface which faces one of the active surfaces of the compensator slide valve and is exposed to the same pressure and a second surface exposed, for a first piston whose first surface faces the first surface of the compensator slide valve, to the load sensing pressure and for a second piston whose first surface faces the second surface of the compensator slide valve, to the working pressure; and a spring urging the first piston towards the compensator slide valve.

These features offer the advantage of enabling the invention to be implemented subject only to particularly simple modifications to a prior art distributor such as that described in the previously mentioned patent 84-06747.

Preferably, the first and second active surfaces of the compensator slide valve are of similar size, the first active surface of the first and second pistons are of similar size and the second active surfaces of the first and second pistons are of similar size.

If $S_1$ denotes the effective surface area of the first and second surfaces of the compensator slide valve, $S_2$ denotes the effective surface area of the first surfaces of the pistons, $S_3$ denotes the effective surface area of the second surfaces of the pistons and F denotes the force applied by the spring:

$$k_1 = S_3/(S_1 - S_2)$$

$$k_2 = F/(S_1 - S_2)$$

Note that the invention is directed not only to the proportional distributor that has just been described but also to a control system for a plurality of hydraulic receivers having a distributor as previously described for each receiver.

Preferably, for the reasons explained above, each distributor includes a compensator slide valve operating according to the same linear function.

Alternatively, at least one of the distributors is a compensator slide valve operating according to a different linear function.

It is then possible to establish a priority of load-shedding or of maintained operation for one or more receivers.

A preferred embodiment of the invention will be described hereinafter by way of non-limiting example with reference to the drawings appended hereto.

DETAILED DESCRIPTION OF THE PREFERRED EMBODIMENT

Figure 1:
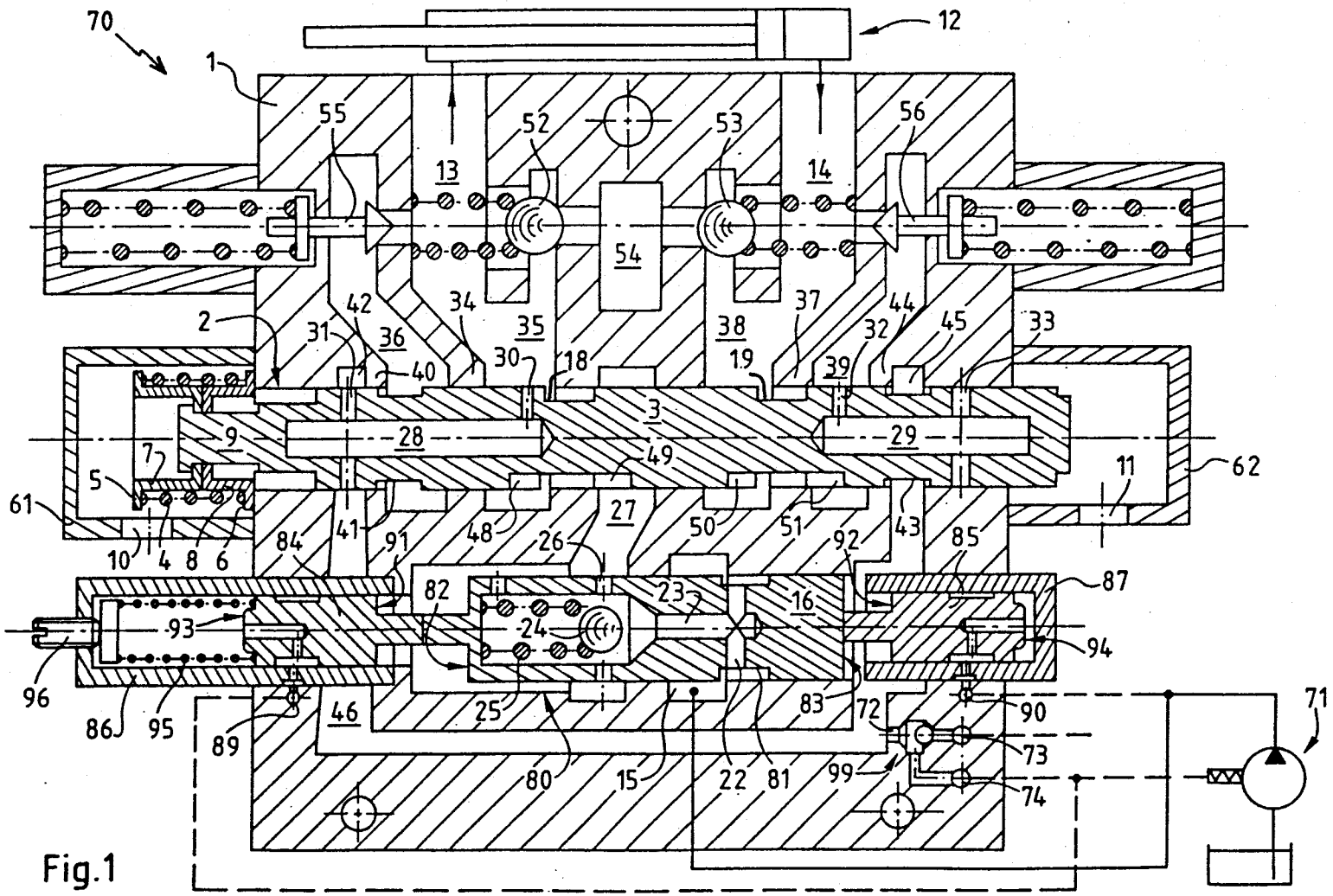
FIG. 1 is a diagrammatic view in cross section of a proportional distributor in accordance with the invention.

A proportional distributor 70 as shown in FIG. 1 is similar to that described in the U.S. Pat. No. 4,736,770, except for its pressure compensator device.

It includes a stator block 1 inside a bore 2 in which slides a cylindrical controlled slide valve 3. In the usual way, the hydraulic circuits are switched by moving grooves in the slide valve 3 across ports of the stator block 1.

At its left-hand end, for example, the slide valve 3 is provided with a common return spring device made up of a helical spring 4 compressed between the shoulders 5 and 6 of two ribs 7 and 8 which are trapped between two shoulders on the end 9 of the slide valve 3 and the stator block 1, around which they can slide. The slide valve 3 is, therefore, naturally returned to a neutral rest position but is pushed to the right (FIG. 1) when control pressure is applied to an aperture 10 of a fixed cap 61. It is pushed to the left when control pressure is applied to an aperture 11 in the cap 62 of the other end. In the example shown, it is assumed that the three-position slide valve 3 is used to control a double-acting hydraulic ram 12. To this end, one section of the hydraulic ram 12 is connected to a first load passage 13 of the stator block 1 and the opposite section of the hydraulic ram 12 is connected to a second load passage 14 of the stator block 1.

An annular feed chamber 15 in the distributor receives pressure from a flow generator 71.

The annular feed chamber 15 surrounds a cylindrical compensator slide valve 16 provided with a radial bore 22 communicating with a blind axial bore 23. The latter discharges onto a seat adapted to be closed or uncovered by a ball 24 whose return spring 25 is compressed inside the compensator slide valve 16. The chamber containing the ball 24 and the return spring 25 is compressed inside the compensator slide valve 16. The chamber containing the ball 24 and the return spring 25 discharges through a lateral opening 26 into an annular chamber 27 surrounding the central portion of the slide valve 3.

The slide valve 3 includes respective axial interior bores 28 and 29 at its left-hand and right-hand ends.

The left-hand interior bore 28 communicates with the exterior of the slide valve through respective radial bores 30 and 31. Similarly, the right-hand interior bore 29 discharges into radial bores 32 and 33.

When the slide valve 3 is at its neutral or resting position the radial bore 30 faces and is closed by a solid portion 34 of the stator block 1 between two annular chambers 35 and 36. The chamber 35 communicates with the first load passage 13 and the chamber 36 is connected to the return circuit.

In the rest position the radial bore 32 is closed by a solid portion 37 of the stator block 1 between two annular chambers 38 and 39. The chamber 38 communicates with the second load passage 14 and the chamber 39 is connected to the return circuit.

Between the bores 30 and 31 the stator block 1 defines in the bore 2 a solid portion 40 past which an annular groove 41 on the slide valve 3 can move.

There is an annular stator chamber 42 around the slide valve 3, in the area located around the bore 31, when the slide valve 3 is pushed to the right (FIG. 1).

Similarly, at its opposite end the slide valve 3 has another annular groove 43 moving past a solid portion 44 of the stator block 1. Around the radial bore 33 when the slide valve 3 is pushed to the left is an annular stator chamber 45.

The two stator chambers 42 and 45 are interconnected by a so-called load sensing passage 46.

Progressive notches 48, 49, 50 and 51 are provided on grooves 18 and 19 of the slide valve 3.

Finally, a first supercharging valve 52 is connected in parallel with the first load passage 13. Similarly, a second supercharging valve 53 is connected in parallel with the second load passage 14. Between the first and second supercharging valves 52 and 53 and connected thereto is a chamber 54 connected to the oil return circuit.

Overpressure valves 55 and 56 are provided on a side of each of the load passages 13 and 14, and provide for discharge from the first and second chambers 35 and 38 into the respective return chambers 36 and 39.

The operation of the slide valve 3 will now be described.

With the slide valve 3 in the neutral position the chambers 27, 35 and 38 are closed so that the hydraulic ram 12 is immobile because there is no flow into the proportional distributor 70. The load sensing passage 46 communicates via the respective grooves 41 and 43 with the chamber 36 and the chamber 39, and is, therefore, connected to the return circuit.

When control pressure is applied via the aperture 10, as is the case in FIG. 1, the slide valve 3 slides to the right a distance determined by the difference in the force of the control pressure from the oppositely directed force of the compressed helical spring 4, which will be compressed a certain distance depending on the control pressure. The feed pressure from the chamber 27 reaches the first load passage 13 via the notch 49, the groove 18 and the chamber 35, and the second load passage 14 communicates with the return chamber 39 via the groove 19 and the notches 50 and 51. Each of the notches 49 and 51 define a flow restriction whose cross section is determined by the position of the slide valve 3. The load sensing passage 46 communicates at the left-hand end with the first load passage 13 via the bores 31, 28 and 30 and is closed off at the right-hand end. The pressure on the downstream side of the flow restriction determined by the notch 49 is, therefore, transmitted to the load sensing passage 46.

If a control pressure is applied via the aperture 11, the slide valve 3 slides to the left a distance determined by the magnitude of the control pressure. The feed pressure in the chamber 27 reaches the second load passage 14 via the notch 50, the groove 19, and the chamber 36 via the groove 18 and the notch 48. Each of the notches 48 and 50 define a flow restriction whose cross section is determined by the position of the slide valve 3. The load sensing passage 46 communicates at the right-hand end with the second load passage 14 via the bores 33, 29 and 32 and is closed off at the left-hand end when the slide valve is pushed to the left. The pressure on the downstream side of the flow restriction determined by the notch 50 is, therefore, transmitted to the load sensing passage 46.

It is, therefore, provided that in the neutral position the load sensing passage 46 is at the pressure of the return circuit whereas in each of the working positions the load sensing passage 46 is at the pressure of the downstream side of the flow restriction provided by the slide valve 3 on the line feeding the hydraulic ram 12, that is to say the working pressure of the latter.

Figure 2:
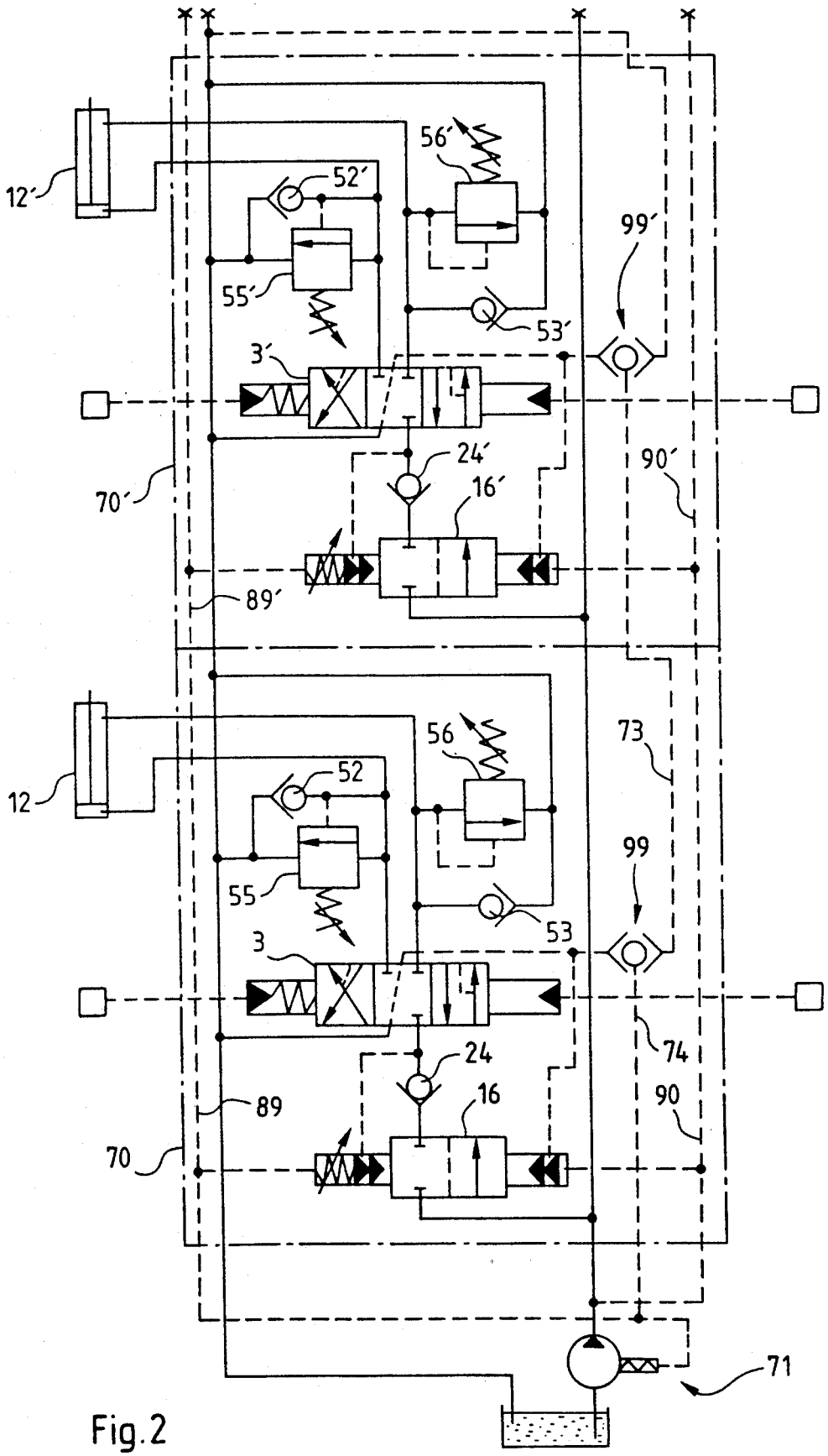
FIG. 2 is a schematic of a hydraulic circuit including a control system with two distributors similar to that shown in FIG. 1 joined together end-to-end.

A circuit selector (also called the "OR function") 99 has one input communicating with the load sensing passage 46 via a passage 72 and a second input which communicates with the passage 73 which can be selectively connected to the output passage of a circuit selector of a second similar proportional distributor as shown in FIG. 2. When the pressure in the load sensing passage 46 is higher than any other proportional distributor in the circuit, the circuit selector 99 assumes the position shown in FIG. 1, at which time its output transmitted to a passage 74 is the load pressure of the ram 12. This is the highest load pressure for the set of receivers fed by the flow generator 71. More generally, as clearly shown in FIG. 2, it is always the pressure of the most heavily loaded receiver that is applied to the passage 74. This so-called load sensing pressure is transmitted to the flow generator 71 so that it can supply a working pressure equal to the load sensing pressure over and above a constant predetermined pressure.

The compensator (or balancing) slide valve 16 is movable in a bore 80 of the stator block 1 and includes around the radial bore 22 a groove 81 which produces a flow restriction of greater or lesser magnitude, depending upon the position of the compensator slide valve 16. The pressure on the upstream side of the flow restriction defined by the slide valve 3 is supplied via the feed line to the hydraulic ram 12, and depends upon the position assumed by the compensator slide valve 16.

The compensator slide valve 16 has two opposing active surfaces, on the left a surface 82 exposed to the pressure of the upstream side of the flow restriction provided by the slide valve 3, and on the right a surface 83 exposed to the pressure of the load sensing passage 46, that is to say the load pressure of the hydraulic ram 12. The compensator slide valve 16 is urged towards the right in the direction which closes the flow restriction that it produces and to the left in the opening direction.

On each end of the compensator slide valve 16 is a coaxial mobile piston, piston 84 is connected to the left end and piston 85 is connected to the right end. Each piston 84 and 85 includes a lug through which it comes into contact with the compensator slide valve 16, and slides in a cylinder 86 and 87, respectively, which are screwed into the stator block 1 coaxially with the bore 80, each cylinder being open at the innermost end and closed at the outermost end, with the cylinder 86 crossing the load sensing passage 46 in a fluid-tight manner.

The pistons 84 and 85 are similar and each constitutes an L-shaped passage for providing communication between the piston 84 and 85 and the bottom of the cylinder 86 and 87 and respective passages 89 and 90. The passage 89 is connected to the load sensing pipe of the flow generator so that it is at the load sensing pressure. The passage 90 is connected to the working pipes so that it is at the working pressure. The pistons 84 and 85 each incorporate two opposing active surfaces. One surface (91 for the piston 84 and 92 for the piston 85) faces the respective active surface of the slide valve 16 (82 and 83, respectively) and is exposed to the same pressure.

A second active surface 93 of the piston 84 is exposed to the load sensing pressure and a second active surface 94 of the piston 85 is exposed to the working pressure. A spring 95 applies a force that can be varied using the screw 96 to press the piston 84 against the compensator slide valve 16.

The effective surface areas of the surfaces 82 and 83 are similar (they are denoted $S_1$) and the same applies to the effective surface areas of the surfaces 91 and 92 ($S_2$) and also to the respective surface areas of the surfaces 93 and 94 ($S_3$).

Using the previous notation:

$$P_i - PU_i = S_3(P - PU)/(S_1 - S_2) - F/(S_1 - S_2)$$

The values of $S_1$, $S_2$, $S_3$ and F are chosen in particular with reference to the following imperatives:

(1) in service the pistons 84 and 85 must remain in contact with the compensator slide valve 16;

(2) the compensator slide valve 16 must close for a certain minimum value a of P−PU such that:

$S_3 \cdot a = F$; and (3) the compensator slide valve 16 must provide in normal service, in which $P - PU = c$, a value b at $P_i - PU_i$ such that:

$$b(S_1 - S_2) = S_3 \cdot c - F.$$

Note that the first imperative mentioned above does not apply in a version in which the pistons 84 and 85 are attached to the compensator slide valve 16.

Note also that it is possible to compensate, to some degree, the differences due to any manufacturing tolerances that may exist between the active surface areas in the various distributors.

Note further that the changes made to the distributor described in U.S. Pat. No. 4,736,770 to obtain the present distributor are particularly simple to implement.

Note additionally that the pipes connected to the passages 89 and 90 may pass through the proportional distributor 70 so that the possibility of making all connections between multiple distributors by simply joining them together end-to-end is retained.

This feature is shown more completely in FIG. 2 which is a schematic showing the proportional distributor 70 joined to a similar proportional distributor 70', all parts of the latter having the same reference number as the former but "primed".

Note in particular the cascaded arrangement of the circuit selectors 99 and 99' whereby the pressure of the most heavily loaded receiver is fed back to the flow generator 71.

In an alternative embodiment directed to maximum simplification, the distributor farthest from the pump (the proportional distributor 70' in FIG. 2) does not have an input of the circuit selector 99' connected to the storage tank; instead its passage 74' is directly connected to the load sensing passage 46'.

The present invention is not limited to the above described examples and encompasses all variants as may be determined by the person skilled in the art without departing from the scope of the present invention.

What is claimed is:

1. A proportional distributor for controlling a hydraulic receiver connected through said proportional distributor to a flow output port of a flow generator adapted to produce on said flow output port a working pressure normally equal to a load sensing pressure, applied thereto at a regulation port, plus a predetermined constant pressure, said proportional distributor comprising:

a controlled flow restriction means having a downstream side connected to said hydraulic receiver; and a compensator flow restriction means having a downstream side connected to an upstream side of said controlled flow restriction means and an upstream side connected to said flow output port of said flow generator, said compensator flow restriction means further having a flow passage between said upstream side and said downstream side thereof, said flow passage comprising a portion having a variable cross-section opening, said compensator flow restriction means being adapted to automatically adjust said variable cross-section opening so as to regulate the pressure difference between said upstream side and said downstream side of said controlled flow restriction means, said compensator flow restriction means further comprising:

a stator housing;

a compensator slide valve reciprocally movable in said stator housing respectively in an opening direction whereby said variable cross-section opening increases and in a closing direction whereby said variable cross-section opening decreases;

a first biasing means communicating with said upstream side of said controlled flow restriction means for urging said compensator slide valve in said closing direction with a force proportional to the pressure on said upstream side of said controlled flow restriction means;

a second biasing means communicating with said downstream side of said controlled flow restriction means for urging said compensator slide valve in said opening direction with a force proportional to the pressure on said downstream side of said controlled flow restriction means;

a third biasing means communicating with said regulation port of said flow generator for urging said compensator slide valve in said closing direction with a force proportional to said load sensing pressure;

a fourth biasing means for urging said compensator slide valve in said closing direction with a substantially constant force; and a fifth biasing means communicating with said flow output port of said flow generator for urging said compensator slide valve in said opening direction with a force proportional to said working pressure, said first, second, third, fourth and fifth biasing means being adapted in service to continuously bring said compensator slide valve into a balance position so that the pressure difference between said upstream side and said downstream side of said controlled flow restriction means is regulated as a function of the difference between said working pressure and said load sensing pressure according to a linear function with a strictly positive coefficient and a strictly negative constant.

2. The proportional distributor according to claim 1 wherein said first biasing means comprises a first active surface on said compensator slide valve;

said second biasing means comprises a second active surface on said compensator slide valve, said second active surface being opposite to said first active surface;

said third biasing means and said fifth biasing means, respectively, comprise a first piston juxtaposed coaxially along one side of said compensator slide valve and a second piston juxtaposed coaxially along another side of said compensator slide valve, each said first piston and second piston having opposing first and second active surfaces, said first active surface faces said first active surface of said compensator slide valve, to sense said upstream pressure, said second active surface of said compensator slide valve further being opposed to said second active surface of said second piston to sense said downstream pressure; and said fourth biasing means comprising a spring urging said first piston in a direction towards said compensator slide valve.

3. The proportional distributor according to claim 2 wherein said first and second active surfaces of said compensator slide valve are of similar size;

said first active surfaces of said first and second pistons are of similar size; and said second active surfaces of said first and second pistons are of similar size.

4. The proportional distributor according to claim 2 further comprising:

a bore located in said stator housing, said compensator slide valve being slidably mounted in said bore;

a first cylinder member attached to said stator housing, said first cylinder member having a bore coaxially aligned with said bore of said stator housing; and a second cylinder member attached to said stator housing, said second cylinder member having a bore coaxially aligned with said bore of said stator housing, one of said first and second pistons being slidably mounted in said bore of one of said first and second cylinder members, the other of said first and second pistons being slidably mounted in said bore of the other of said first and second cylinder members.

5. The proportional distributor according to claim 4 further comprising:

means for sensing and communicating said working pressure to said second active surface of said first piston whereby slidable movement of said first piston is a function of said slidable movement of said compensator slide valve and the differential pressure between the load sensing pressure acting on said first active surface of said first piston and the work sensing pressure acting on said second active surface of said first piston as well as said spring acting on said first piston; and means for sensing and communicating said load sensing pressure to said second active surface of said second piston whereby slidable movement of said second piston is a function of said slidable movement of said compensator slide valve and the differential pressure between the work sensing pressure acting on said first active surface of said second piston and the load sensing pressure acting on the second active surface of said second piston.

6. The proportional distributor according to claim 2 wherein said first and second pistons each further comprise a lug member attached to said first active surface of each said first and second piston; and wherein said compensator slide valve further comprises a lug member attached to one of said first and second active surfaces of said compensator slide valve, said first and second pistons communicating with said compensator slide valve through said lug members.

7. A proportional distributor according to claim 1 wherein said first biasing means comprises means for sensing the pressure existing at said upstream side of said controlled flow restriction means; and further wherein said second biasing means comprises means for sensing the pressure existing at said downstream side of said controlled flow restriction means; and further wherein said third biasing means comprises a first piston juxtaposed a first end surface of said compensator slide valve, said first piston being movable coaxially and adapted to come into contact with said compensator slide valve, said first piston having a first surface and a second surface, said first surface facing said first end surface of said compensator slide valve, said second surface being exposed to said upstream pressure and further wherein said fourth biasing means comprises means for urging said compensator slide valve in a closing direction with a substantially constant force; and further wherein said fifth biasing means comprises a second piston juxtaposed another end surface of said compensator slide valve, said second piston being movable coaxially and adapted to come into contact with said compensator slide valve, said second piston having a first surface and a second surface, said first surface facing said another end surface of said compensator slide valve, said second surface sensing said downstream pressure.

8. The control system according to claim 7 wherein said first and second pistons each have an "L"-shaped passage therein, and said proportional distributor further comprises:

a first and second cylinder each having a closed end and an open end for receiving said first and second pistons, respectively, said first and second cylinders being attached to said stator housing and said open end of said first cylinder facing said open end of said second cylinder, said first and second cylinders communicating with said bore of said stator housing, said first and second cylinder each having a radial bore therethrough for communication with said "L"-shaped passage of said first and second pistons, respectively, said first and second pistons and said closed ends of said first and second cylinders defining a first and second chamber, respectively;

a first pipe connected to said radial bore of said first cylinder for supplying said load sensing pressure to said first chamber via said "L"-shaped passage of said first piston; and a second pipe connected to said radial bore of said second cylinder for supplying said load sensing pressure to said second chamber via said "L"-shaped passage of said second piston.

9. In a control system for controlling a plurality of hydraulic receivers wherein each hydraulic receiver is connected to a flow output port of a flow generator adapted to produce on said flow output port a working pressure normally equal to a load sensing pressure applied thereto at a regulation port in addition to a predetermined constant pressure, said load sensing pressure being the pressure of said one of said hydraulic receivers under the heaviest load, each of said hydraulic receivers being connected to said flow output port through a proportional distributor, wherein each said proportional distributor comprises:

a controlled flow restriction means having a downstream side connected to one of said plurality of hydraulic receivers; and a compensator flow restriction means having a downstream side connected to an upstream side of said controlled flow restriction means and an upstream side connected to said flow output port of said flow generator, said compensator flow restriction means further having a flow passage between said upstream side and said downstream side thereof, said flow passage comprising a portion having a variable cross-section opening, said compensator flow restriction means being adapted to automatically adjust said variable cross-section opening so as to regulate the pressure difference between said upstream side and said downstream side of said controlled flow restriction means, said compensator flow restriction means further comprising:

a stator housing;

a compensator slide valve reciprocally movable in said stator housing respectively in an opening direction whereby said variable cross-section opening increases and in a closing direction whereby said variable cross-section opening decreases;

a first biasing means communicating with said upstream side of said controlled flow restriction means for urging said compensator slide valve in said closing direction with a force proportional to the pressure on said upstream side of said controlled flow restriction means;

a second biasing means communicating with said downstream side of said controlled flow restriction means for urging said compensator slide valve in said opening direction with a force proportional to the pressure on said downstream side of said controlled flow restriction means;

a third biasing means communicating with said regulation port of said flow generator for urging said compensator slide valve in said closing direction with a force proportional to said load sensing pressure;

a fourth biasing means for urging said compensator slide valve in said closing direction with a substantially constant force; and a fifth biasing means communicating with said flow output port of said flow generator for urging said compensator slide valve in said opening direction with a force proportional to said working pressure, said first, second, third, fourth and fifth biasing means being adapted in service to continuously bring said compensator slide valve into a balance position so that the pressure difference between said upstream side and said downstream side of said controlled flow restriction means is regulated as a function of the difference between said working pressure and said load sensing pressure according to a linear function with a strictly positive coefficient and a strictly negative constant.

10. The control system according to claim 9 wherein each said compensator slide valve of each said proportional distributor operates according to the same linear function.

11. The control system according to claim 9 wherein at least one of said compensator slide valves of one of said proportional distributors comprises a compensator slide valve operating according to a different linear function.

12. The control system according to claim 9 wherein:

said first biasing means comprises a first active surface which faces one of said active surfaces on said compensator slide valve;

said second biasing means comprises a second active surface on said compensator slide valve, said second active surface being opposite to said first active surface;

said third biasing means and said fifth biasing means, respectively, comprise a first piston juxtaposed coaxially along one side of said compensator slide valve and a second piston juxtaposed coaxially along another side of said compensator slide valve, each said first piston and second piston having opposing first and second active surfaces, said first active surface faces said first active surface of said compensator slide valve to sense said upstream pressure, said second active surface of said compensator slide valve further being opposed to said second active surface of said second piston to sense said downstream pressure; and said fourth biasing means comprising a spring urging said first piston in a direction towards said compensator slide valve.

13. The control system according to claim 9 wherein:

said first and second active surfaces of said compensator slide valve are of similar size;

said first active surfaces of each of said first and second pistons are of similar size; and said second active surfaces of each of said first and second pistons are of similar size.

14. The control system according to claim 9 further comprising:

a bore located in said stator housing, said compensator slide valve being slidably mounted in said bore;

a first cylinder member attached to said stator housing, said first cylinder member having a bore coaxially aligned with said bore of said stator housing; and a second cylinder member attached to said stator housing, said second cylinder member having a bore coaxially aligned with said bore of said stator housing, one of said first and second pistons being slidably mounted in said bore of one of said first and second cylinder members, the other of said first and second pistons being slidably mounted in said bore of the other of said first and second cylinder members.

15. The control system according to claim 14 further comprising:

means for sensing and communicating said working pressure to said second active surface of said first piston whereby slidable movement of said first piston is a function of said slidable movement of said compensator slide valve and the differential pressure between the load sensing pressure acting on said first active surface of said first piston and the work sensing pressure acting on said second active surface of said first piston as well as said spring acting on said first piston; and means for sensing and communicating said load sensing pressure to said second active surface of said second piston whereby slidable movement of said second piston is a function of said slidable movement of said compensator slide valve and the differential pressure between the work sensing pressure acting on said first active surface of said second piston and the load sensing pressure acting on said second active surface of said second piston.

16. The control system according to claim 12 wherein said first and second pistons each further comprise a lug member attached to said first active surface of each said first and second piston; and wherein said compensator slide valve further comprises a lug member attached to one of said first and second active surfaces of said compensator slide valve, said first and second pistons communicating with said compensator slide valve through said lug members.

17. The control system according to claim 9 wherein said first biasing means comprises means for sensing the pressure existing at said upstream side of said controlled flow restriction means; and further wherein said second biasing means comprises means for sensing the pressure existing at said downstream side of said controlled flow restriction means; and further wherein said third biasing means comprises a first piston juxtaposed a first end surface of said compensator slide valve, said first piston being movable coaxially and adapted to come into contact with said compensator slide valve, said first piston having a first surface and a second surface, said first surface facing said first end surface of said compensator slide valve, said second surface being exposed to said upstream pressure; and further wherein said fourth biasing means comprises means for urging said compensator slide valve in a closing direction with a substantially constant force; and further wherein said fifth biasing means comprises a second piston juxtaposed another end surface of said compensator slide valve, said second piston being movable coaxially and adapted to come into contact with said compensator slide valve, said second piston having a first surface and a second surface, said first surface facing said another end surface of said compensator slide valve, said second surface sensing said downstream pressure.

18. The control system according to claim 17 wherein said first and second pistons each have an "L"-shaped passage therein, and said proportional distributor further comprises:

a first and second cylinder each having a closed end and an open end for receiving said first and second pistons, respectively, said first and second cylinders being attached to said stator housing and said open end of said fist cylinder facing said open end of said second cylinder, said first and second cylinders communicating with said bore of said stator housing, said first and second cylinder each having a radial bore therethrough for communication with said "L"-shaped passage of said first and second pistons, respectively, said first and second pistons and said closed ends of said first and second cylinders defining a first and second chamber, respectively;

a first pipe connected to said radial bore of said first cylinder for supplying said load sensing pressure to said first chamber via said "L"-shaped passage of said first piston; and a second pipe connected to said radial bore of said second cylinder for supplying said load sensing pressure to said second chamber via said "L"-shaped passage of said second piston.

* * * * *

UNITED STATES PATENT AND TRADEMARK OFFICE

CERTIFICATE OF CORRECTION

PATENT NO. : 5,222,426

DATED : June 29, 1993

INVENTOR(S) : Louis Marcon and Andre Rousset

It is certified that error appears in the above-identified patent and that said Letters Patent is hereby corrected as shown below:

Column 2, line 43, delete "mos" and insert ---- most ----.

Column 14, line 8, delete "fist" and insert ---- first ----.

Signed and Sealed this

Twenty-sixth Day of April, 1994

Bruce Lehman

*Attest:*

BRUCE LEHMAN

*Attesting Officer*

*Commissioner of Patents and Trademarks*